US009033029B2

(12) United States Patent
Park et al.

(10) Patent No.: US 9,033,029 B2
(45) Date of Patent: May 19, 2015

(54) HEAT EXCHANGER

(75) Inventors: Taegyun Park, Seoul (KR); Sehyeon Kim, Seoul (KR); Seungmo Jung, Seoul (KR); Eungyul Lee, Seoul (KR); Sanghoon Yoo, Seoul (KR); Naehyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 359 days.

(21) Appl. No.: 13/358,699

(22) Filed: Jan. 26, 2012

(65) Prior Publication Data

US 2013/0126140 A1 May 23, 2013

(30) Foreign Application Priority Data

Nov. 18, 2011 (KR) ..... 10-2011-0120898

(51) Int. Cl.
*F28F 9/02* (2006.01)
*F28D 1/053* (2006.01)
*F28F 1/32* (2006.01)

(52) U.S. Cl.
CPC ..... *F28F 9/0273* (2013.01); *F28F 9/0204* (2013.01); *F28F 9/0278* (2013.01); *F28F 9/028* (2013.01); *F28D 1/05375* (2013.01); *F28F 1/32* (2013.01)

(58) Field of Classification Search
CPC ..... F28D 1/05375; F28D 1/05383; F28D 1/05391; F28F 1/32; F28F 9/0207; F28F 9/0278; F28F 9/0204; F28F 9/0217; F28F 9/028
USPC ..... 165/151, 140, 149, 173, 174, 175, 176
See application file for complete search history.

(56) References Cited

U.S. PATENT DOCUMENTS

| | | | | |
|---|---|---|---|---|
| 2,488,623 | A | 11/1949 | Goeltz | |
| 3,675,710 | A * | 7/1972 | Ristow | 165/111 |
| 3,710,854 | A | 1/1973 | Staub | |
| 5,203,407 | A * | 4/1993 | Nagasaka | 165/174 |
| 6,430,945 | B1 * | 8/2002 | Haussmann | 62/117 |
| 7,819,177 | B2 * | 10/2010 | Beamer et al. | 165/174 |
| 2003/0188857 | A1 | 10/2003 | Kawakubo et al. | |
| 2004/0159121 | A1 | 8/2004 | Horiuchi et al. | |
| 2005/0092462 | A1 * | 5/2005 | Makino et al. | 165/67 |

(Continued)

FOREIGN PATENT DOCUMENTS

| | | |
|---|---|---|
| CN | 101558277 | 10/2009 |
| EP | 1 884 733 | 2/2008 |

(Continued)

OTHER PUBLICATIONS

Korean Office Action dated Jul. 11, 2013.

(Continued)

*Primary Examiner* — Mohammad M Ali
*Assistant Examiner* — Raheena Rehman
(74) *Attorney, Agent, or Firm* — KED & Associates, LLP

(57) ABSTRACT

A heat exchanger is provided. The heat exchanger may include a plurality of refrigerant tubes extending in a horizontal direction, at least one fin coupled to the plurality of refrigerant tubes, a vertically oriented header coupled to corresponding ends of the plurality of refrigerant tubes, the header distributing refrigerant into the plurality of refrigerant tubes, and a partition device that partitions an inner space of the header, the partition device including at least two through holes that guide refrigerant into the plurality of refrigerant tubes.

20 Claims, 7 Drawing Sheets

(56) References Cited

U.S. PATENT DOCUMENTS

| | | | | |
|---|---|---|---|---|
| 2008/0047687 | A1* | 2/2008 | Leitch et al. | 165/70 |
| 2008/0251245 | A1 | 10/2008 | Gorbounov et al. | |
| 2008/0296005 | A1* | 12/2008 | Taras et al. | 165/173 |
| 2009/0113711 | A1* | 5/2009 | Tsuji et al. | 29/890.03 |
| 2009/0120627 | A1 | 5/2009 | Beamer et al. | |
| 2010/0089095 | A1* | 4/2010 | Macri et al. | 62/525 |
| 2010/0206535 | A1* | 8/2010 | Munoz et al. | 165/173 |

FOREIGN PATENT DOCUMENTS

| | | | |
|---|---|---|---|
| EP | 2 375 209 | | 10/2011 |
| JP | 04-043772 | U | 4/1992 |
| JP | 05-346297 | | 12/1993 |
| JP | 8-9578 | | 3/1996 |
| JP | 08-233409 | | 9/1996 |
| JP | 09-189498 | | 7/1997 |
| JP | 2003-075024 | | 3/2003 |
| JP | 2004-003810 | | 1/2004 |
| JP | 2004-226030 | | 8/2004 |
| JP | 2006-284134 | | 10/2006 |
| JP | 2008-528935 | | 7/2008 |
| JP | 2008-528942 | | 7/2008 |
| KR | 10-2005-0104072 | | 11/2005 |
| KR | 10-2006-0130776 | | 12/2006 |
| KR | 10-2008-0004852 | A | 1/2008 |
| WO | WO 2005/012823 | | 2/2005 |
| WO | WO 2009/048451 | | 4/2009 |

OTHER PUBLICATIONS

European Search Report issued in EP Application No. 12193079.6 dated Apr. 17, 2013.

International Search Report issued in PCT Application No. PCT/KR2012/009612 dated Mar. 26, 2013.

Korean Notice of Allowance dated Dec. 27, 2013.

Chinese Office Action dated Aug. 4, 2014. (translation).

Chinese Office Action dated Jan. 20, 2015.

* cited by examiner

HEAT EXCHANGER

CROSS-REFERENCE TO RELATED APPLICATION(S)

This application claims priority under 35 U.S.C. §119 to Korean Application No. 10-2011-0120898 filed on Nov. 18, 2011, whose entire disclosure is hereby incorporated by reference.

BACKGROUND

1. Field

This relates to a heat exchanger.

2. Background

A heat exchanger may be a part of a heat exchange cycle. The heat exchanger may serve as a condenser or evaporator to heat-exchange a refrigerant flowing therein with an external fluid.

Heat exchangers may be classified into a fin-and-tube type and a micro channel type according to a shape thereof. The fin-and-tube type heat exchanger includes a plurality of fins and a tube having a circular shape or a somewhat circular shape passing through the fins. The micro channel type heat exchanger includes a plurality of flat tubes through which a refrigerant flows and a fin disposed between the plurality of flat tubes. In the pin-and-tube type heat exchanger and the micro channel type heat exchanger, a refrigerant flowing through the tubes is heat-exchanged with an external fluid, and the fin may increase a heat exchange area between the refrigerant flowing into the tubes or flat tubes and the external fluid.

BRIEF DESCRIPTION OF THE DRAWINGS

The embodiments will be described in detail with reference to the following drawings in which like reference numerals refer to like elements wherein.

DETAILED DESCRIPTION

Refrigerant flowing into a heat exchanger may be in a two-phase state. However, just before discharge from the heat exchanger, the refrigerant may be in a gaseous state or have a very high vapor quality. Thus, a flow rate of the refrigerant to be discharged from the heat exchanger may be relatively higher than that of the refrigerant introduced into the heat exchanger.

Thus, the refrigerant may be concentrated t an outlet side of the heat exchanger having a high-speed flow rate. In particular, when a header coupled to at least one end of the flat tubes is oriented vertically, gravity may act on the refrigerant within the header to concentrate the refrigerant into the flat tubes disposed at a lower portion of the outlet side.

Thus, an amount of refrigerant flowing into one flat tube may be different from an amount of refrigerant flowing into another flat tube, thus deteriorating heat exchange efficiency.

Hereinafter, exemplary embodiments will be described with reference to the accompanying drawings. Embodiments may include many different forms and should not be construed as being limited to the embodiments set forth herein; rather, alternative embodiments falling within the spirit and scope of the present disclosure may fully convey the concept to those skilled in the art.

Figure 1:
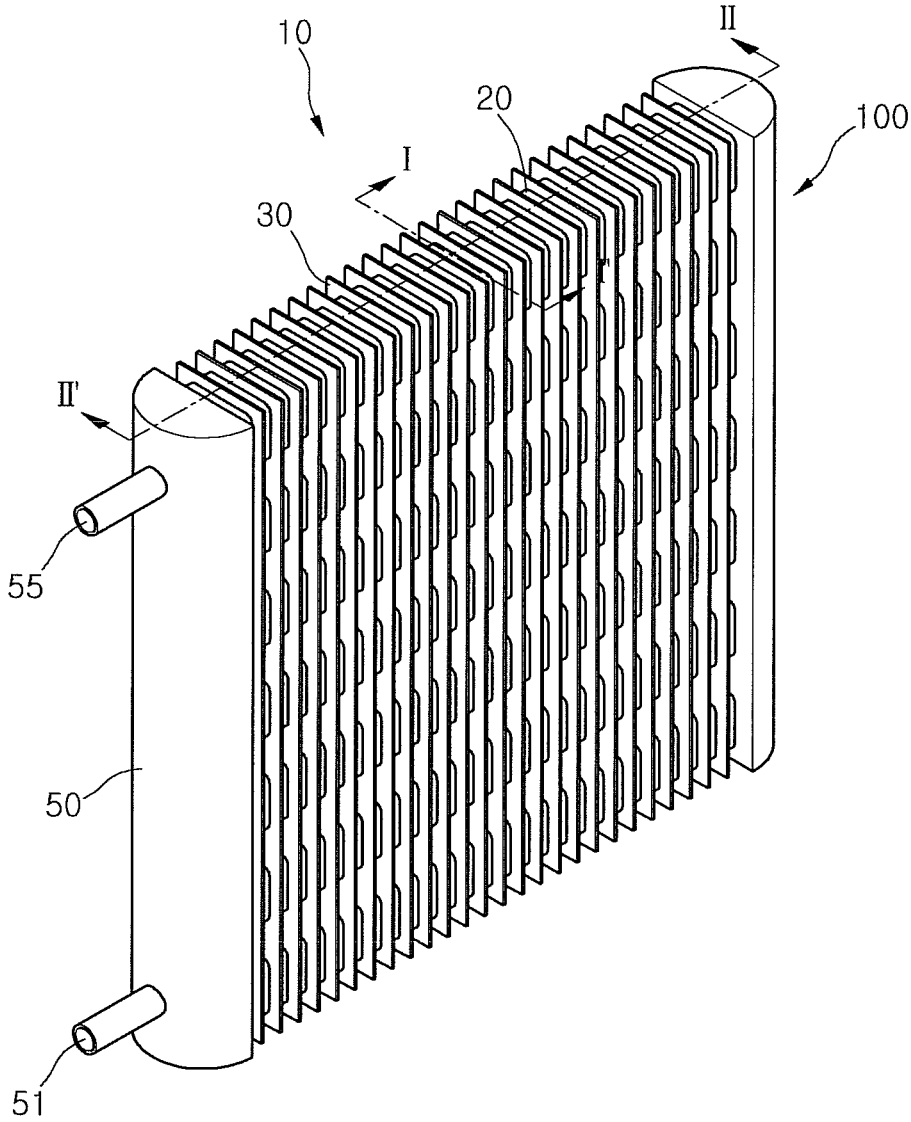
FIG. 1 is a perspective view of a heat exchanger according to an embodiment as broadly described herein.
Figure 2:
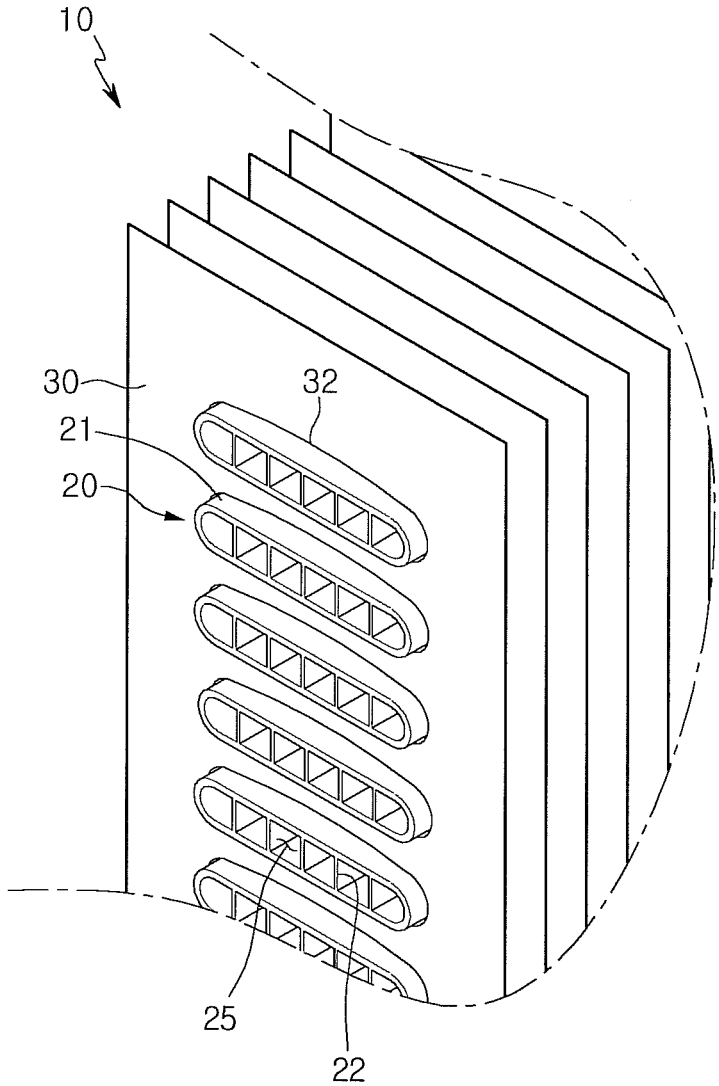
FIG. 2 is a sectional view taken along line I-I' of FIG. 1.
Figure 3:
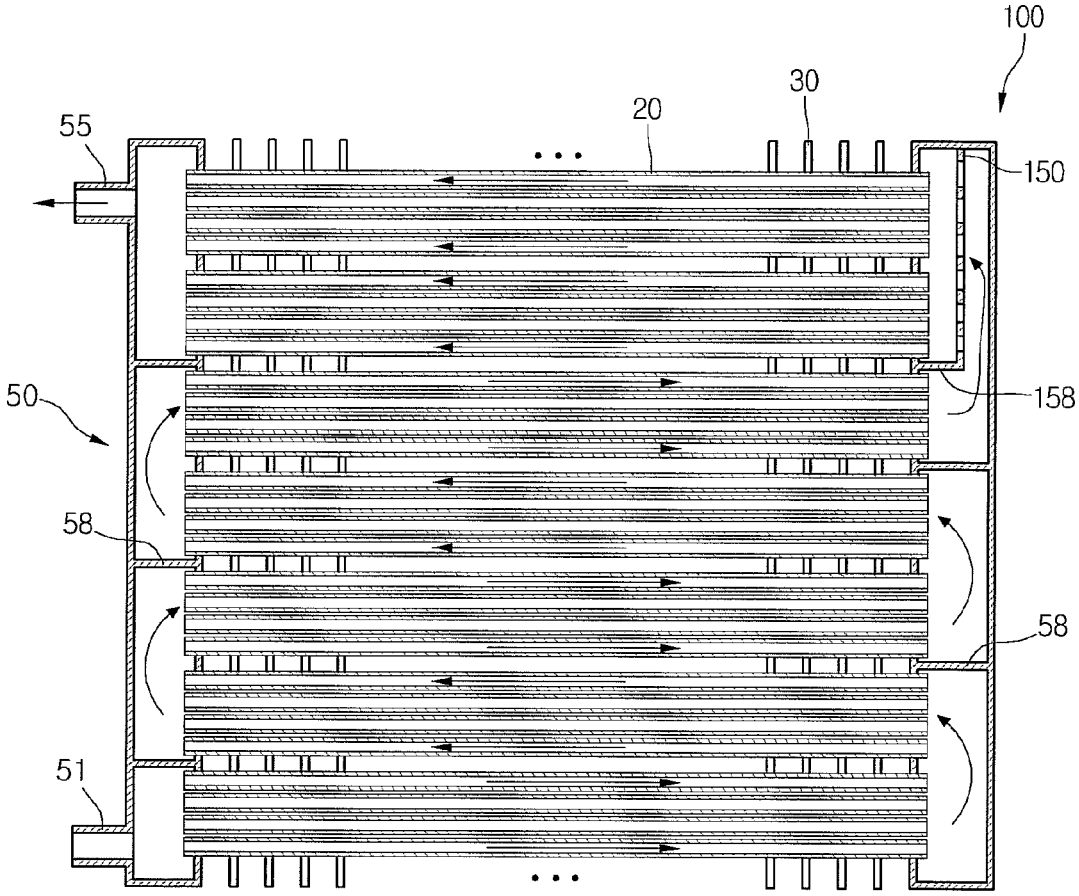
FIG. 3 is a sectional view taken along line II-II' of FIG. 1.

Referring to FIGS. 1 to 3, a heat exchanger 10 according to an embodiment as broadly described herein may include headers 50 and 100 extending by a predetermined length in upward and downward directions, or a vertical direction, a plurality of flat tubes 20 coupled to the headers 50 and 100 to extend in a horizontal direction, or left and right directions, and a plurality of heatsink fins 30 arranged at a predetermined distance between the headers 50 and 100 and passing through the flat tubes 20. The headers 50 and 100 may be called "vertical headers" in that the headers 50 and 100 extend vertically.

The headers 50 and 100 include a first header 50 including a refrigerant inlet 51 through which refrigerant may be introduced into the heat exchanger 10 and a refrigerant outlet 55 through which refrigerant which has undergone heat-exchange in the heat exchanger 10 may be discharged, and a second header 100 spaced apart from the first header 50. First ends of the plurality of flat tubes 20 may be coupled to the first header 50, and second ends of the plurality of flat tubes 20 may be coupled to the second header 100.

A flow space for the refrigerant may be defined in each of the first and second headers 50 and 100. The refrigerant within the first or second header 50 or 100 may be introduced into the flat tubes 20, and a flow direction of the refrigerant flowing into the flat tubes 20 may be converted in the first or second header 50 or 100.

For example, a flow direction of the refrigerant flowing in a left direction through the flat tubes 20 may be converted in the first header 50 to flow in a right direction. Also, a flow direction of the refrigerant flowing in the right direction through the flat tubes 20 may be converted in the second header 100 to flow in the left direction (see FIG. 3). Thus, the first header 50 and/or the second header 100 may be referred to as "return headers".

The refrigerant inlet 51 may be disposed at a lower portion of the first header 50, and the refrigerant outlet 55 may be disposed at an upper portion of the first header 50. The refrigerant introduced into the refrigerant inlet 51 may flow in a direction opposite to that of gravity while circulating through the flat tubes 20 and then be discharged through the refrigerant outlet 55. That is, the refrigerant may flow upward from the refrigerant inlet 51 toward the refrigerant outlet 55.

The plurality of flat tubes 20 may be disposed between the first and second headers 50 and 100, and may be spaced apart from each other in a vertical direction so as to form a vertical stack of flat tubes 20.

Each of the flat tubes 20 may include a tube body 21 defining an outer appearance thereof and one or more partition ribs 22 defining a plurality of refrigerant passages 25 (i.e., micro channels) within the tube body 10 that allow refrigerant to uniformly flow into the plurality of refrigerant passages 25. Through holes 32 through which the plurality of flat tubes 20 pass may be formed in the fin 30.

One or more baffles 58 for guiding the refrigerant so that the refrigerant flows along a zigzag pattern via the first header 50, the flat tubes 20, and the second header 100 may be provided in the first header 50 and/or the second header 100.

The one or more baffles 58 may partition an inner space of the first and/or second header 50 or 100 into upper and lower portions.

A passage of the refrigerant flowing along the flat tubes 20 may form an S shape due to the baffle(s) 58. As the passage flowing along the flat tubes 20 forms such an S-shaped line, contact area and time between the refrigerant and air may increase to improve heat exchange efficiency.

Thus, the inner space of the first header 50 and/or the second header 100 may be partitioned into a plurality of spaces by the baffle(s) 58. Each of the partitioned spaces may form a space in which a refrigerant flow into the flat tubes 20 starts.

A partition device 150 for partitioning the inner space of the second header 100 in left and right directions and a blocking rib 158 disposed at a lower portion of the partition device 150 may be provided in the second header 100. The partition device 150 may be provided in, for example, the uppermost space of the spaces partitioned by the baffle(s) 58. The blocking rib 158 may extend across a lower portion of the left or right space partitioned by the partition part 150. FIG. 3 illustrates a state in which the lower portion of the left space is covered.

In detail, the partition part 150 may be provided at a height corresponding to that of the refrigerant outlet 55, and in particular, at a height corresponding to those of the plurality of flat tubes 20 coupled to one side (left or right side) of the refrigerant outlet 55.

That is, the partition 150 may be provided adjacent to a set of passages that is closer to the refrigerant outlet 55 than the refrigerant inlet 51.

In the exemplary embodiment shown in FIG. 3, the inlet 51 and outlet 55 are respectively provided at lower and upper ends of the first header 50, with multiple baffles 58 in each of the first and second headers 50 and 100 forming multiple partitioned spaces therein. However, the arrangement of the inlet 51, outlet 55, partition device 150, blocking rib 158, number and arrangement of baffles 58 may all be adjusted as necessary/appropriate for a particular application/environment.

A flow of the refrigerant in accordance with the arrangement shown in the exemplary embodiment will be described with reference to FIG. 3.

The refrigerant introduced through the refrigerant inlet 51 flows into the plurality of flat tubes 10 in a right to left direction when viewed in FIG. 3. An upward flow of the refrigerant above a predetermined height may be restricted by the first baffle 58 provided in the first header 50 above the refrigerant inlet 51. The refrigerant passing through the flat tube 20 flows upward in the second header 100, and then a flow direction of the refrigerant is converted to flow a left to right direction. In the second header 100, an upward flow of the refrigerant above a predetermined height may be restricted by the baffle 58 disposed in the second header 100.

The refrigerant circulation process (left to right or right to left flow) may be repeatedly performed, as shown, for example, in FIG. 3. As described above, the repetition of the refrigerant circulation process may be facilitated by the baffle(s) 58. The refrigerant flow may progress upward toward the refrigerant outlet 55, i.e., in a direction opposite to that of gravity.

In such a circulation process, when the refrigerant reaches an upper portion of the second header 100, the refrigerant flows upward along the partition device 150 and flows from one side of the partition device 150 to the other side.

That is, the refrigerant passes through the partition part 150 to flow into the flat tubes 20. From the flat tubes 20, the refrigerant is introduced into the first header 50 and discharged to the outside of the heat exchanger 10 through the refrigerant outlet 55.

Hereinafter, a second header according to one embodiment will be described with reference to FIGS. 4-6.

Figure 4:
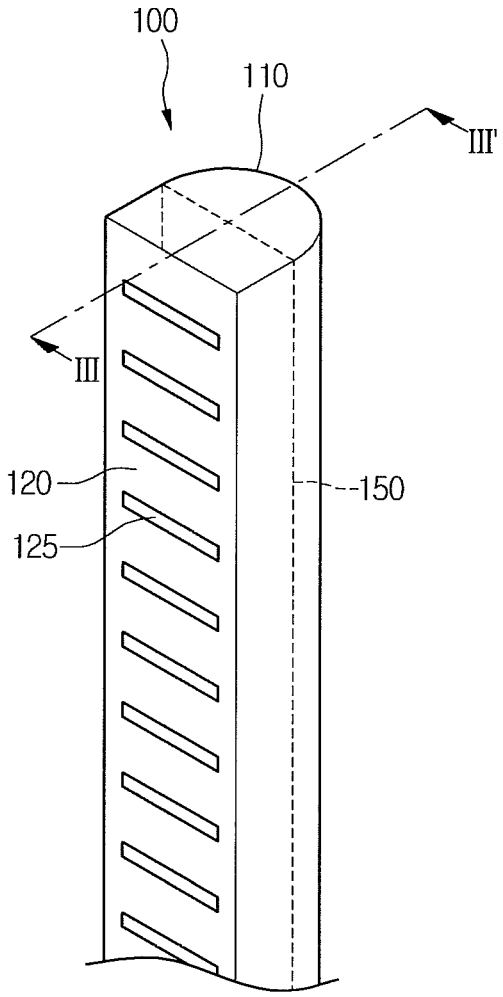
FIG. 4 is a perspective view of a header assembly of the heat exchanger shown in FIG. 1.
Figure 5:
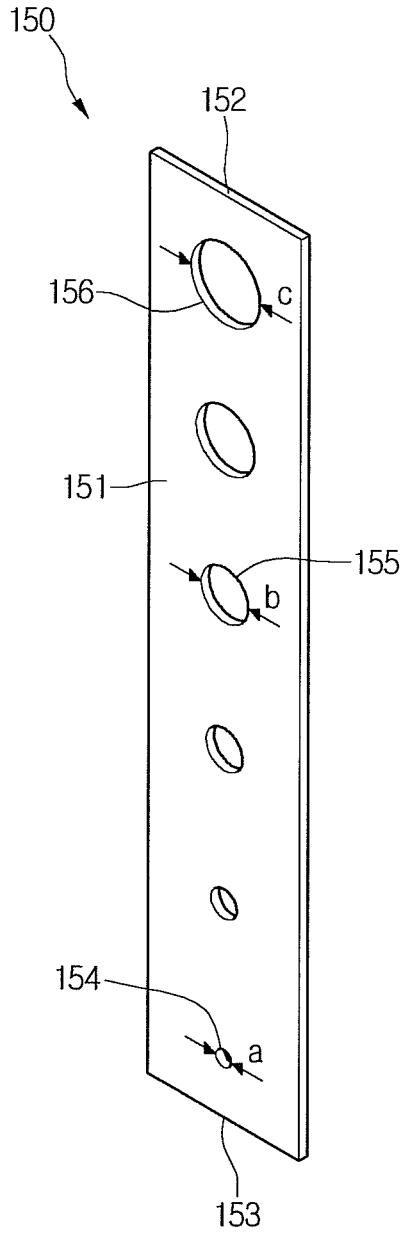
FIG. 5 is a perspective view of a partition part of the heat exchanger shown in FIG. 1.
Figure 6:
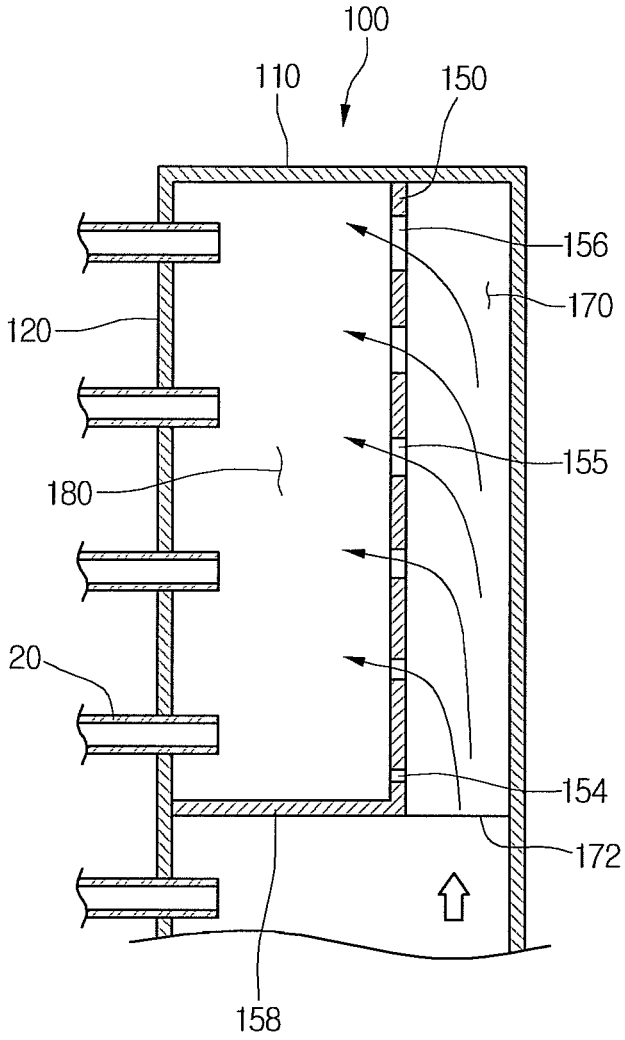
FIG. 6 is a sectional view taken along line III-III' of FIG. 4.

Referring to FIGS. 4 to 6, the second header 100 may include a header body 110 defining a refrigerant flow space and a tube coupling plate 120 covering a front side of the header body 110 and coupled to the flat tubes 20. The header body 110 and the tube coupling plate 120 may be separate parts that are coupled together or may be integrally formed.

A plurality of coupling holes 125 may be formed in the tube coupling plate 120. The number of coupling holes 125 may correspond to that of the flat tubes 20. Also, the plurality of coupling holes 125 may be vertically spaced apart from each other. For example, the plurality of coupling holes 125 may be spaced apart from each other at the same distance.

The partition device 150 for partitioning the flow space within the second header 100 may extend downward from an inner surface of an upper end of the header body 110. The partition device 150 may horizontally partition an upper space of the second header 100. In a case in which the refrigerant flows upward in the second header 100, the partition device 150 may extend substantially parallel to a flow direction of the refrigerant.

The partition device 150 includes a partition plate 151 having a plate shape and a plurality of holes 154, 155 and 156 passing through the partition plate 151 and disposed along the flow direction of the refrigerant. The partition plate 151 may function as a "blocking plate" which partitions a portion of the inner space of the second header 100 to prevent the refrigerant from being introduced all at once into a specific flat tube 20.

The plurality of holes 154, 155 and 156 may guide the refrigerant flowing through the partition device 150 so that the refrigerant flowing along one side of the partition plate 151 is uniformly distributed as it flows to the other side of the partition plate 151.

In detail, the plurality of holes 154, 155 and 156 may include a first hole 154 disposed at an uppermost end with respect to the flow direction of the refrigerant, a second hole 155 spaced apart from the first hole 154 in the flow direction of the refrigerant, and a third hole 156 spaced apart from the second hole 155 in the flow direction of the refrigerant.

That is, in this exemplary embodiment, the second hole 155 is disposed downstream from the first hole 154, and the third hole 156 is disposed downstream from the second hole 155. For example, when the refrigerant flows upward from a lower portion of the partition device 150, the first hole 154 may be disposed at a lower end of the partition device 150. The second hole 155 may be disposed at an approximately central portion of the partition device 150, and the third hole 156 may be disposed at an upper end of the partition device 150. Although reference numerals are given provided for the above-described three holes in this exemplary embodiment, a plurality of holes may be additionally disposed between the holes 154, 155 and 156. Thus, multiple arrangements, combinations, shapes and/or sizes of holes may be appropriate.

The plurality of holes 154, 155 and 156 may have sizes that different from each other. For example, in the embodiment shown in FIG. 5, the second hole 155 has a diameter "b" greater than a diameter "a" of the first hole 154, and the third hole 156 has a diameter "c" greater than the diameter "b" of the second hole 155. Thus, in this exemplary embodiment, the upstream hole may have a smaller overall size than that of downstream hole with respect to the flow direction of the refrigerant.

As a plurality of holes may be disposed between the first hole 154 and the third hole 156, the plurality of holes may have gradually increasing sizes from the first hole 154 toward the third hole 156.

For example, when the heat exchanger 10 serves as an evaporator, the refrigerant introduced into the heat exchanger 10 may have a two-phase state. Also, the refrigerant may be evaporated while passing through the heat exchanger 10 to increase vapor quality. In this case, the closer the refrigerant gets to the refrigerant outlet 55, the more the refrigerant reaches a gaseous state.

Since a flow rate of the gaseous refrigerant is greater than that of the liquid refrigerant, the refrigerant may be concentrated into at least one flat tube 20 of the plurality of flat tubes 20 before the refrigerant is discharged from the refrigerant outlet 55. Specifically, when the headers 50 and 100 are vertically disposed, as shown in FIG. 3, the at least one flat tube 20 may be a lower flat tube 20 of the plurality of flat tubes 20 due to gravity.

Thus, in the current embodiment, a position of the first hole 154 may correspond to that of the lowest flat tube 20 of the plurality of flat tubes 20 covered by the partition device 150, and a position of the third hole 156 may correspond to that of an uppermost flat tube 20. That is to say, the first, second and third holes 154, 155 and 156 may be sequentially disposed upward from a lower end of the partition plate 151.

Thus, the refrigerant may be uniformly distributed into the second or third hole 155 or 156 having a size greater than that of the first hole 154 as well as the first hole 154 to pass through the holes 154, 155 and 156 because the first hole 154 has the smallest size, rather than the majority of the refrigerant being concentrated at and directed into the lower flat tubes 20.

The partition device 150 may include a top surface coupling device 152 defining a top surface of the partition plate 151 and coupled to an interior side of a top surface of the header body 110, and a rib coupling device 153 defining a bottom surface of the partition plate 151 and coupled to the blocking rib 158.

The partition device 150 extends downward from the top surface of the header body 100 by a predetermined length. The blocking rib 158 is coupled to a lower end of the partition device 150. The blocking rib 158 extends forward from the lower end of the partition device 150 and is coupled to the tube coupling plate 120.

The flow space of the refrigerant defined in an upper portion of the second header 100 is horizontally partitioned by the partition device 150. A first passage 170 through which the refrigerant flows toward the partition device 150 and a second passage 180 through which the refrigerant passing through the partition device 150 flows toward the flat tubes 20 are disposed in the partitioned flow space.

A passage inflow port 172 through which the refrigerant is introduced into the first passage 170 may be defined at a lower end of the first passage 170 by a space formed between the end of the blocking rib 158 and a corresponding surface of the header body 110 of the second header 100.

The refrigerant introduced through the refrigerant inlet 51 flows upward while also performing heat exchange. When the refrigerant reaches an upper portion of the second header 100, the refrigerant is introduced into the first passage 170 through the passage inflow port 172.

Due to the difference of the sizes of the holes 154, 155 and 156, the refrigerant may pass through the partition device 150 through the second or third hole 155 or 156, each having a relatively larger size, as well as the nearest first hole 154 with respect to the flow direction of the refrigerant. That is, the refrigerant may be uniformly distributed as it passes through holes formed along the entire sectional area of the partition device 150.

The refrigerant passing through the partition device 150 flows along the second passage 180 and then is introduced into the plurality of flat tubes 20. Since the plurality of flat tubes 20 may be arranged to correspond to the partition device 150, the refrigerant may be uniformly distributed into the plurality of flat tubes 20.

Since the lower end of the second passage 180 may be covered by the blocking rib 158, refrigerant may be introduced into the second passage 180 through the passage inflow port 172, the first passage 170, and the partition device 150.

Another exemplary embodiment will now be described with respect to FIG. 7.

Although each of the plurality of holes 154, 155 and 156 shown in FIG. 5 has a substantially circular shape with a predetermined diameter, each of the plurality of holes 154, 155 and 156 may have a different shape, such as, for example, a slit shape cut in a horizontal or a vertical direction, or other shape, size and/or orientation as appropriate.

Although a portion of the inner space of the header may be partitioned by the partition device shown in FIGS. 3-6, in alternative embodiments, a separate tube, instead of the partition device, may be provided to partition the refrigerant passage.

Figure 7:
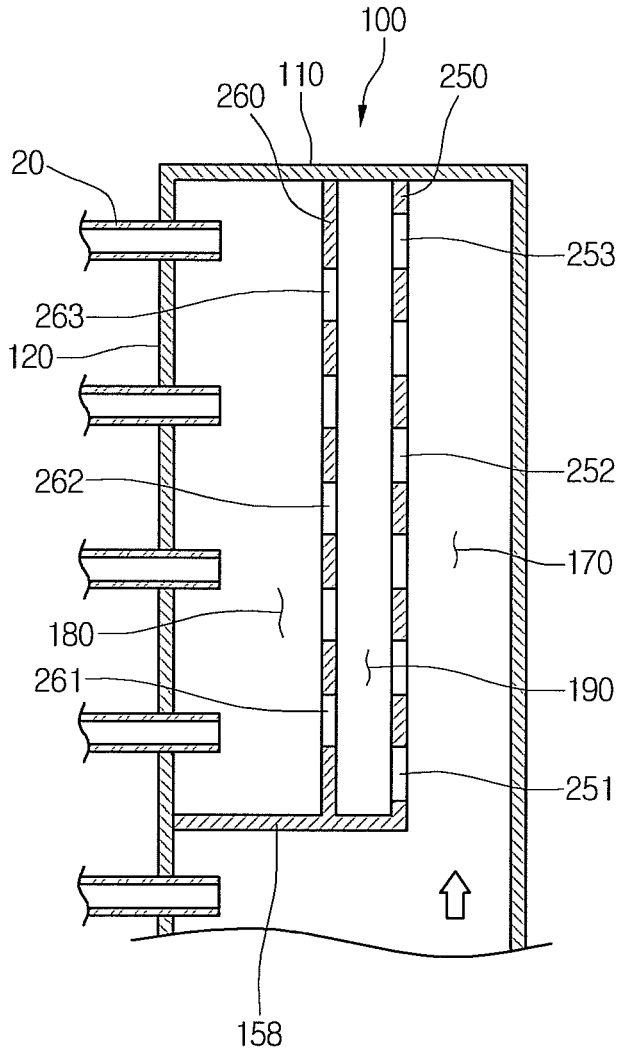
FIG. 7 is a sectional view of a header according to another embodiment as broadly described herein.

Referring to FIG. 7, a second header 100 according to another embodiment as broadly described herein may include a plurality of partition devices 250 and 260 for partitioning an upper space of the second header 100. The plurality of partition devices 250 and 260 may include a first partition device 250 coupled to an end of a blocking rib 158 and a second partition device 260 spaced from the first partition device 250, in the direction of a tube coupling plate 120, and coupled to the blocking rib 158.

A plurality of through holes through which refrigerant passes may be defined in the first partition device 250. The plurality of through holes may include, for example, a first hole 251, a second hole 252, and a third hole 253 which are disposed sequentially upward from a lower end to an upper end of the first partition device 250. A plurality of holes, in addition to the three through holes 251, 252 and 253 shown in FIG. 7, may also be formed in the first partition device 250.

As described in the foregoing embodiment, the plurality of through holes 251, 252 and 253 may have sizes gradually increasing from the first hole 251 toward the third hole 253. Alternatively, the first, second and third holes 251, 252 and 253 may have substantially the same size. Other arrangements, shapes, sizes and quantities of through holes may also be appropriate.

A plurality of through holes through which refrigerant passes are defined in the second partition device 260. The plurality of through holes may include, for example, a fourth hole 261, a fifth hole 262, and a sixth hole 263 which are disposed upward from a lower end to an upper end of the second partition device 260. A plurality of holes, in addition to the three through holes 261, 262 and 263 shown in FIG. 7, may also be formed in the second partition device 160.

As described in the foregoing embodiment, the plurality of through holes 261, 263 and 253 may have sizes gradually increasing from the forth hole 261 toward the sixth hole 263. Alternatively, the fourth, fifth and sixth holes 261, 262 and 263 may have substantially the same size. Other arrangements, shapes, sizes and quantities of through holes may also be appropriate.

An upper space of the second header 100 may be partitioned into a plurality of passages by the first and second partition devices 250 and 260.

In detail, the plurality of passages may include a first passage 170 through which the refrigerant introduced into the upper portion of the second header 100 through a passage inflow port 172 flows toward the first partition device 250, a second passage 180 through which the refrigerant passing through the second partition device 260 flows into flat tubes 20, and a third passage 190 defined as a space between the first partition device 250 and the second partition device 260 to allow the refrigerant passing through the first partition device 250 to flow toward the second partition device 260.

In a state in which the first and second partition devices 250 and 260 face each other, as shown in FIG. 7, the through holes 251, 252 and 253 of the first partition device 250 and the through holes 261, 262 and 263 of the second partition device 260 may be disposed at different heights such that the holes of the second partition device 260 are somewhat offset from the holes of the first partition device 250.

For example, a position of the fourth hole 261 may be higher than that of the first hole 251, a position of the fifth hole 262 may be higher than that of the second hole 252, and a position of the sixth hole 263 may be higher than that of the third hole 253. In certain exemplary embodiments, a lower end of the fourth hole 261 may be at a position corresponding to that of a central portion of the first hole 251, and upper ends of the fifth and sixth holes 262 and 263 may be at positions corresponding to lower ends of the second and third holes 252 and 253, respectively.

In alternative embodiments, the first, second and third holes 251, 252 and 253 may be disposed at positions higher than those of the fourth, fifth and sixth holes 261, 262 and 263, respectively. Numerous other relative arrangements of the through holes formed in the first and second partition devices 250 and 260 may also be appropriate.

As described above, the through holes 251, 252 and 253 of the first partition device 250 and the through holes 261, 262 and 263 of the second partition device 260 may be positioned at different heights. Thus, the flow of refrigerant passing through the first, second and third holes 251, 252 and 253 into the fourth, fifth and sixth holes 261, 262 and 263 may be somewhat impeded.

Thus, the flow rate of the refrigerant in the third passage 190 may be reduced, and kinetic energy of the refrigerant may be reduced. Such an arrangement may prevent the refrigerant introduced into the first passage 170 through the passage inflow port 172 from being concentrated into the first hole 251, and the refrigerant may flow into the second hole 252 or the third hole 253 due to an inertial force of the refrigerant.

Thus, a plurality of partition devices may be provided within the second header 100, and the through holes defined in each of the partition devices may have different heights to reduce or regulate the flow rate of the refrigerant. Thus, the refrigerant may be uniformly distributed into the upper through holes as well as the lower through holes of the plurality of through holes as it passes through the partition devices.

In a heat exchanger as embodied and broadly described herein, a partition device for guiding refrigerant flow may be provided in a header, and a plurality of through holes having different sizes may be defined in the partition device to allow refrigerant to be uniformly distributed.

Specifically, since a size of the through holes gradually increase in the flow direction of the refrigerant, the refrigerant may be easily drawn toward and through even the farther through holes.

In a heat exchanger as embodied and broadly described herein, a plurality of partition devices may be provided in the header to reduce or regulate a flow rate (or kinetic energy) between the plurality of partition devices and flow due to inertial force. Such an arrangement may prevent the refrigerant flow from being concentrated into a nearest through hole with respect to the flow direction of the refrigerant.

Therefore, refrigerant may be uniformly distributed into the plurality of flat tubes to improve heat exchange efficiency between the refrigerant and the surrounding air.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a plurality of refrigerant tubes that extends in a horizontal direction;

at least one fin coupled to the plurality of refrigerant tubes, wherein the at least one fin performs heat exchange with fluid flowing through the plurality of refrigerant tubes; and a header coupled to ends of the plurality of refrigerant tubes, wherein the header extends vertically so as to distribute a refrigerant into the plurality of refrigerant tubes, the header comprising:

a header body;

a tube coupling plate coupled to the header body so as to define an interior space together with the header body, wherein the plurality of refrigerant tubes are coupled to the header body;

a partition device that partitions a predetermined portion of the interior space of the header, wherein the partition device comprises:

a first partition that extends downward from an inner top surface of the header body and includes a plurality of first holes that extends therethrough;

a second partition that extends downward from the inner top surface of the header body, spaced apart from the first partition in a direction towards the tube coupling plate and includes a plurality of second holes that extends therethrough; and a blocking rib that extends from the tube coupling plate into the interior space defined by the tube coupling plate and the header body and contacts bottom edges of the first and second partitions;

a first flow passage formed between the first partition and an inner side surface of the header that faces the first partition;

a second flow passage formed between the second partition and an inner side surface of the tube coupling plate; and a third flow passage formed between the first flow passage and the second flow passage, wherein the plurality of first holes guides the refrigerant in the first flow passage to flow into the third flow passage, wherein the plurality of second holes guides the refrigerant in the third flow passage to flow into the second flow passage, and wherein a horizontal width of the third flow passage is less than a horizontal width of the first flow passage such that the refrigerant of the first flow passage mixes in the third flow passage.

2. The heat exchanger of claim 1, wherein the plurality of first holes have different sizes.

3. The heat exchanger of claim 2, wherein a size of a downstream hole of the plurality of first holes is greater than a size of an upstream hole of the plurality of first holes with respect to a flow direction of the refrigerant.

4. The heat exchanger of claim 1, wherein the header further comprises:

a refrigerant inlet provided at a lower portion of the header through which the refrigerant is introduced into the heat exchanger; and a refrigerant outlet spaced vertically upward from the refrigerant inlet through which the refrigerant which has passed through the plurality of refrigerant tubes is discharged.

5. The heat exchanger of claim 4, wherein the partition device is positioned in a refrigerant passage formed in the header and is aligned with the refrigerant outlet.

6. The heat exchanger of claim 1, wherein the header further comprises at least one baffle that partitions a refrigerant flow space formed within the header into a plurality of vertically arranged spaces within the header, and wherein the at least one baffle changes a refrigerant flow direction in a corresponding one of the plurality of vertically arranged spaces.

7. The heat exchanger of claim 6, wherein the partition device is provided in an uppermost space of the plurality of vertically arranged spaces.

8. The heat exchanger of claim 1, wherein the header body and the tube coupling plate are integrally formed.

9. The heat exchanger of claim 1, further comprising:

an inlet port formed at a bottom end of the first flow passage, between a bottom edge of the first partition and the inner side surface of the header, wherein the inlet port guides the refrigerant into the first flow passage, the first partition guides the refrigerant from the first flow passage into the third flow passage via the plurality of first holes, the second partition guides the refrigerant from the third flow passage into the second flow passage via the plurality of second holes, and the second flow passage guides the refrigerant into a predetermined grouping of refrigerant tubes of the plurality of refrigerant tubes.

10. The heat exchanger of claim 2, wherein a size of the plurality of first holes gradually increases from a lower end to an upper end of the first partition.

11. The heat exchanger of claim 1, wherein the plurality of second holes is offset with respect to the plurality of first holes.

12. The heat exchanger of claim 1, wherein the plurality of second holes have different sizes.

13. The heat exchanger of claim 12, wherein a size of the plurality of second holes gradually increases from a lower end to an upper end of the second partition.

14. The heat exchanger of claim 12, wherein a size of a downstream hole of the plurality of second holes is greater than a size of an upstream hole of the plurality of second holes with respect to a flow direction of the refrigerant.

15. The heat exchanger of claim 1, wherein the refrigerant flows upward from a lower portion of the first partition toward an upper portion of the first partition.

16. The heat exchanger of claim 1, wherein the plurality of first holes of the first partition and the plurality of second holes of the second partition are arranged at different heights.

17. The heat exchanger of claim 1, wherein a flow rate of the refrigerant within the third passage is less than a flow rate of the refrigerant within the first passage.

18. The heat exchanger of claim 1, wherein the tube coupling plate includes a plurality of coupling holes formed vertically spaced apart from each other corresponding to the plurality of refrigerant tubes, and wherein the plurality of refrigerant tubes is connected to the plurality of coupling holes, respectively.

19. The heat exchanger of claim 1, wherein the at least one fin includes a plurality of through holes formed vertically spaced from each other corresponding to the plurality of refrigerant tubes, and wherein the plurality of refrigerant tubes passes through the plurality of through holes of the at least one fin, respectively.

20. The heat exchanger of claim 1, wherein the plurality of refrigerant tubes comprises a plurality of flat tubes, and wherein each of the plurality of flat tubes includes a tube body that defines an outer appearance thereof and one or more partition ribs that define a plurality of refrigerant passages within the tube body.

* * * * *